United States Patent [19]

Briggs

[11] Patent Number: 4,918,752

[45] Date of Patent: Apr. 24, 1990

[54] HELMET WITH DETACHABLE FRONT SECTION

[75] Inventor: Michael Briggs, St. Albans, England

[73] Assignee: Helmet Limited, Moat Factory, Hertfordshire, England

[21] Appl. No.: 191,060

[22] Filed: May 6, 1988

[30] Foreign Application Priority Data

May 8, 1987 [GB] United Kingdom ..... 8710960

[51] Int. Cl.[5] ..... A42B 3/02

[52] U.S. Cl. ..... 2/6; 2/424

[58] Field of Search ..... 2/6, 422, 423, 424, 2/425, 427, 410

[56] References Cited

U.S. PATENT DOCUMENTS

| | | | |
|---|---|---|---|
| 3,502,074 | 3/1970 | Jones | 2/6 X |
| 3,943,571 | 3/1976 | Boatman | 2/6 X |
| 4,075,715 | 2/1978 | Cowgill | 2/6 |
| 4,227,520 | 10/1980 | Lord | 2/6 |
| 4,587,676 | 5/1986 | Estadella | 2/424 |
| 4,633,532 | 1/1987 | Yagasaki | 2/424 |
| 4,794,652 | 1/1989 | von Planta et al. | 2/424 X |

FOREIGN PATENT DOCUMENTS

| | | | |
|---|---|---|---|
| 0236912 | 9/1987 | European Pat. Off. . | |
| 8704449 | 6/1987 | Fed. Rep. of Germany . | |
| 2434251 | 3/1980 | France . | |
| 2532528 | 3/1984 | France | 2/424 |
| 2546381 | 11/1984 | France | 2/410 |
| 982720 | 2/1965 | United Kingdom | 2/6 |
| 1047237 | 11/1966 | United Kingdom . | |
| 1527842 | 10/1978 | United Kingdom . | |
| 2041724 | 9/1980 | United Kingdom | 2/410 |
| 2155762 | 10/1985 | United Kingdom | 2/6 |
| 2175490 | 12/1986 | United Kingdom . | |

*Primary Examiner*—Wm. Carter Reynolds

[57] ABSTRACT

A helmet, particularly an aircrew helmet, has a rear part (10) and a front part (12). The rear part (10) includes a shell shaped to extend partially over the top of the wearer's head and to each side of the head. The front part (12) is shaped to fit against the rear part (10) to complete the shell of the helmet, and is detachably connected to the rear part. The front part (12) is shaped to accommodate equipment for optical protection or enhancement, such as a visor or night vision goggles. A single helmet may have two or more interchangeable front parts with different optical equipment. The front part (12) may be connected to the rear part (10) by releasable catches (50, 54) at the top and sides of the helmet. The catch (50) at the top may allow the front part (12) to pivot upwards to enable the helmet to be donned and doffed without detaching the front part.

6 Claims, 5 Drawing Sheets

HELMET WITH DETACHABLE FRONT SECTION

This invention relates to helmets.

More particularly, but not exclusively the invention relates to aircrew helmets.

Pilots of military aircraft can nowadays be supplied with a range of equipment providing optical aids, such as night vision goggles, position sensing systems or helmet-mounted sights, or providing optical protection, such as tinted visors, or filters providing protection against lasers or nuclear flash. It would be advantageous for such equipment to be accommodated at least partially within the helmet. However, this gives rise to the problems that it is impossible to mount all the equipment in a single helmet, and that the helmet would have to be adapted in different ways to accommodate different equipment.

It is the object of this invention to provide a versatile helmet.

This invention consists in a helmet having a rear part and a detachable front part, the rear part comprising a shell shaped to extend to at least partially over the top of the wearer's head and to each side of the head, the front part being shaped to accommodate equipment for optical enhancement or protection, the front part being shaped to fit against the rear part to complete the shell of the helmet, and means for detachably connecting the front part to the rear part.

Preferably, the front part of the helmet is shaped to accommodate the equipment so that the equipment is at least partially enclosed by the helmet.

The front part of the helmet may be designed to accommodate a particular piece or pieces of optical equipment. The helmet may be provided with a single rear part, and two or more interchangable front parts, each accommodating a different piece of equipment and each shaped to fit against the common rear part.

The front and rear parts of the helmet may be provided with complementary facing surfaces which engage one another when the parts are connected together.

The means for connecting the front and rear parts together may include hinge means connecting the two parts so that the front part can be pivoted upwards from the closed position to enable the helmet to be donned and doffed.

The invention is particularly advantageous when applied to aircrew helmets.

The rear part of the aircrew helmet may contain the ear capsules and associated headset enabling voice communication with the wearer. Where the optical equipment mounted in the front part of the helmet requires electrical connections to other equipment or to a source of electricity, the connections may be made to the rear part of the helmet through electrical contacts incorporated in the connection means between the front and rear parts.

The invention will now be described, by way of example, with reference to the accompanying drawings, in which.

Figure 1:
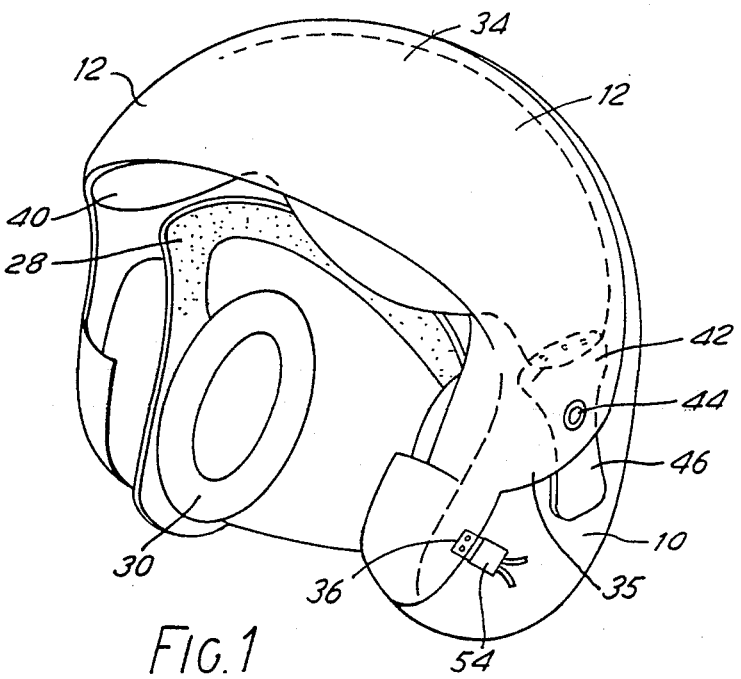
FIG. 1 is a perspective view of a helmet in accordance with the invention.
Figure 2:
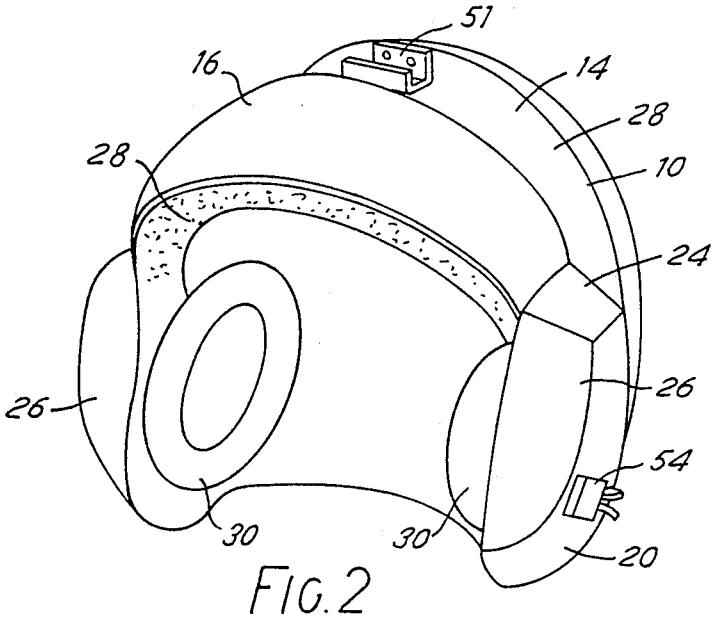
FIG. 2 is a perspective view of the rear part of the helmet.
Figure 3:
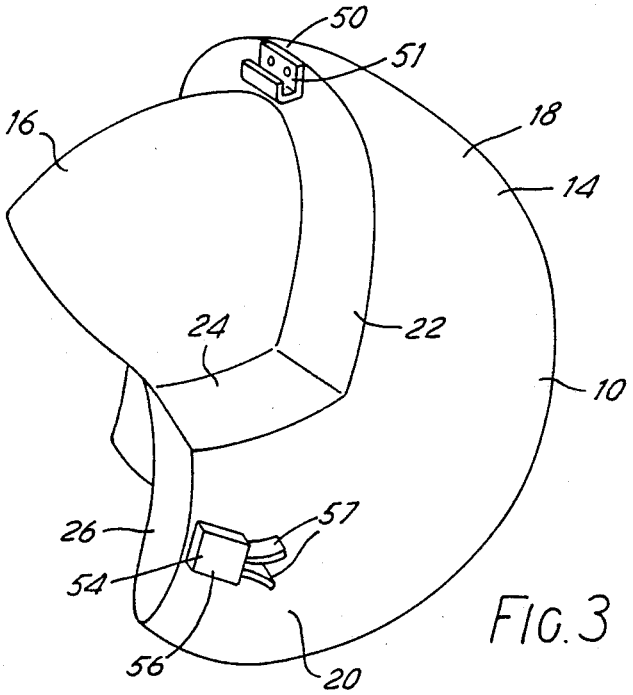
FIG. 3 is a side view of the rear part.
Figure 4:
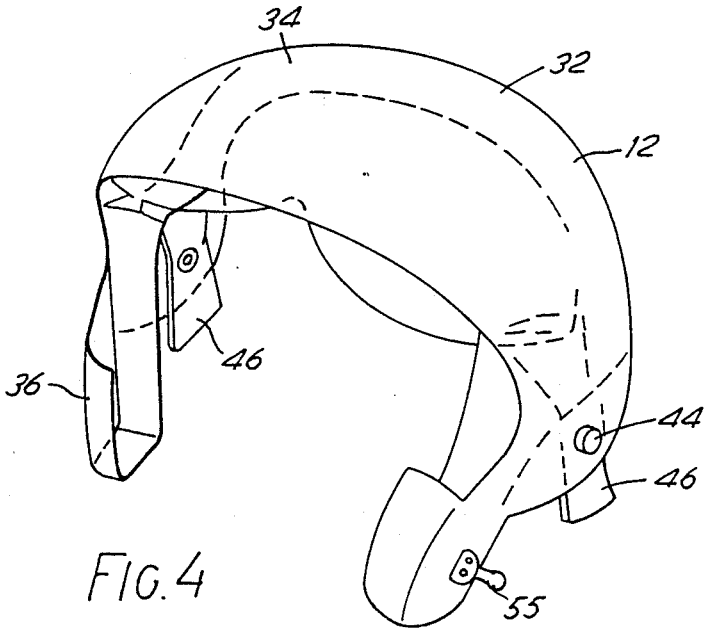
FIG. 4 is a perspective view of the front part of the helmet.
Figure 5:
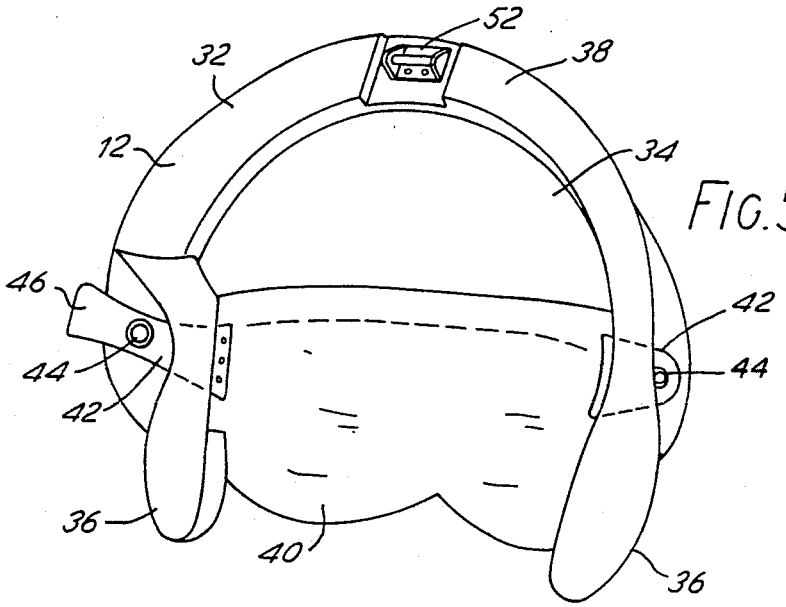
FIG. 5 is a rear perspective view of the front part of the helmet.

Referring to the drawings, an aircrew helmet in accordance with the invention comprises a rear part 10 and a front part 12.

The rear part 10 has an outer shell 14 which extends in use around the back and over the top of the wearer's head, and part way along each side of the head. The shell 14 is shaped so that the forward portion 16 of the shell in offset closer to the wearer's head, and part way along each shell. The forward position 16 is joined to the rear portion 18 of the shell through a forwardly facing portion 22 and to each of the side portions 20 through a forwardly facing portion 24. At their front edges, the side portions 20 are turned in to form flanges providing forwardly facing surfaces 26.

The rear part 10 also has a shock-attenuating liner 28, for example manufactured from foam plastics. A neck pad (not shown) may be provided for fit adjustment. Ear capsules 30, adapted to support a headset for voice communication with the wearer, are suspended from the inner faces of the side portion 20 of the outer shell 14. The ear capsules and associated equipment are of conventional construction and will not be described further.

The front part 12 of the helmet has an outer shell 32 with a portion 34 which in use extends over the forward portion 16 of the rear part 10 of the helmet, and side portions 36 which extend in front of the side portion 20 of the rear part 12. At its rear edges the shell 32 is turned inwards to form a flange 38 which is shaped to fit against the surfaces 22, 24 and 26 of the rear part 10.

The front and rear parts 10 and 12 are releasably held together by catches 50 and 54. Catch 50 at the top of the helmet consists of a hook 51 fixed to the rear part 10 and a rod fixed by a bracket to the front part 12. The rod engages the hook so that the front part 12 can pivot upwards, to allow the helmet to be donned and doffed, without detaching the front part 12 from the rear part 10. The front part 12 can be detached by lifting the rod 52 from the hook 51. To hold the front part 12 in the closed position, releasable catches 54 are provided at each side of the helmet. Each catch 54 consists of a head 55 fixed to the front part 12 and positioned to engage in a spring-loaded latch device 56 fixed to the rear part 10. The latch device 56 has release levers 57 operable to release the head 55. The device may be of the same form as that described U.S. Pat. No. 4,648,138 entitled "Retention and quick release mechanism", the contents of which are incorporated herein by reference. Alternatively, other suitable catch mechanisms could be used.

Figure 6:
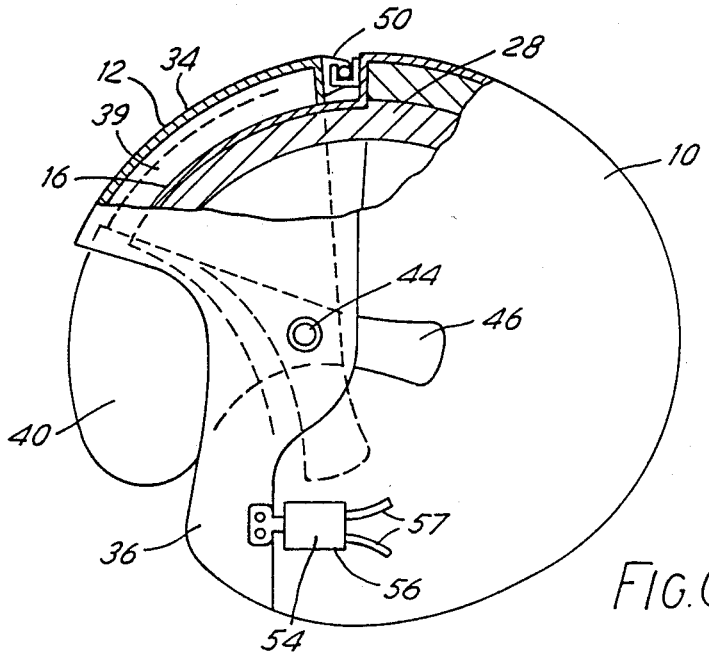
FIG. 6 is a side view of the helmet, partly in section.

Mounted on the front part 12 of the helmet is optical equipment in the form of a sun-glare visor 40. When the two parts 10 and 12 of the helmet are fitted together, the offset portion 16 of the rear part 10 and the portion 34 of the front part 12 define between them a gap 39 (FIG. 6) which provides a space to receive the rotatable sun-glare visor 40 mounted in the front part 12. The visor 40 is carried by two arms 42 which are mounted inside the shell 32, on pivot pins 44. The pivot pins 44 are on portions 35 of the shell which project rearwardly from the flange 38 and lie outside the shell 14 of the rear part 10. One of the arms 42 has a part 46 projecting outwards to provide an operating lever by means of which the visor 40 can be moved between an operative position and a retracted position in which it is housed in the space 39 between the portion 16 and 34 of the front and rear parts of the helmet. The visor could alternatively be provided with an operating mechanism as described in copending U.S. application No. 128,108 filed 3rd December 1987 entitled "Helmet and visor mechanism therefore", the contents of which are incorporated herein by reference.

The visor 40 is thus accommodated within the detachable front part of the housing. The front part of the housing could be adapted to accommodate other optical enhancement or protection equipment, such as night vision goggles or other protective visor equipment such as laser or blast screens. The helmet could be supplied with a single rear part, and two or more interchangeable front parts, for example with one front part as shown housing a sun-glare visor and another housing night vision goggles or other equipment. For example, FIG. 9 shows a helmet with a single rear part 910 and two interchangeable front parts 912 and 922, one front part 912 housing a visor 940 (as in the embodiment of FIGS. 1 to 6) and the other front part 922 being provided with night vision goggles 950 (as in the embodiment of FIGS. 7 and 8, described below).

The helmet can be provided with attachments to hold an oxygen mask, the attachments being fixed either to the rear part or the front part of the helmet. The attachments could, for example, be as described in the above mentioned U.S. Pat. No. 4,648,138.

It will be appreciated that modifications could be made in the described embodiment. For example, more than one visor could be accommodated within the front part of the helmet. A sun-glare visor and a blast visor could be provided, mounted as described in the above mentioned copending patent application No. 128,108. Where a single visor is fitted, there will normally be sufficient space left within the front part of the helmet to accommodate adjacent to the shell a shock-absorbing liner to provide additional protection above that of the rear part of the helmet.

Figure 7:
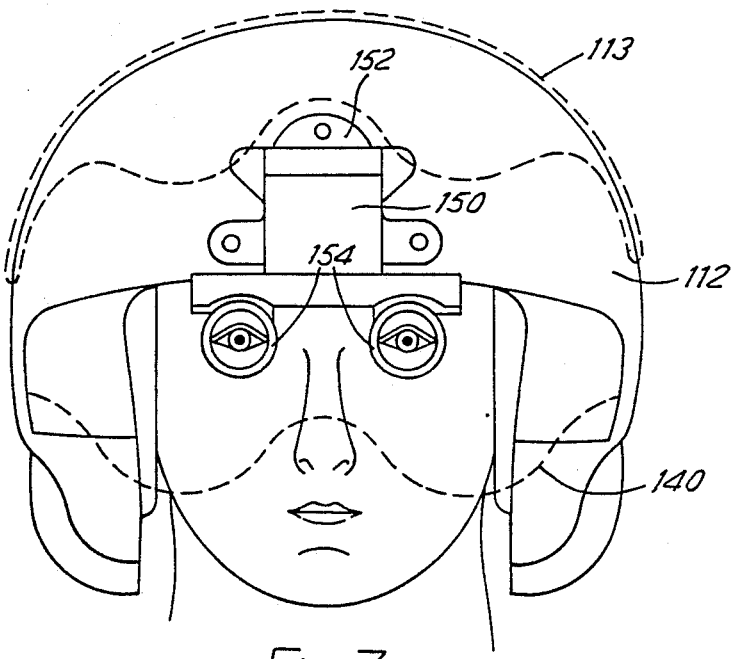
FIG. 7 is a front view of a helmet in accordance with another embodiment of the invention, fitted with night vision goggles.
Figure 8:
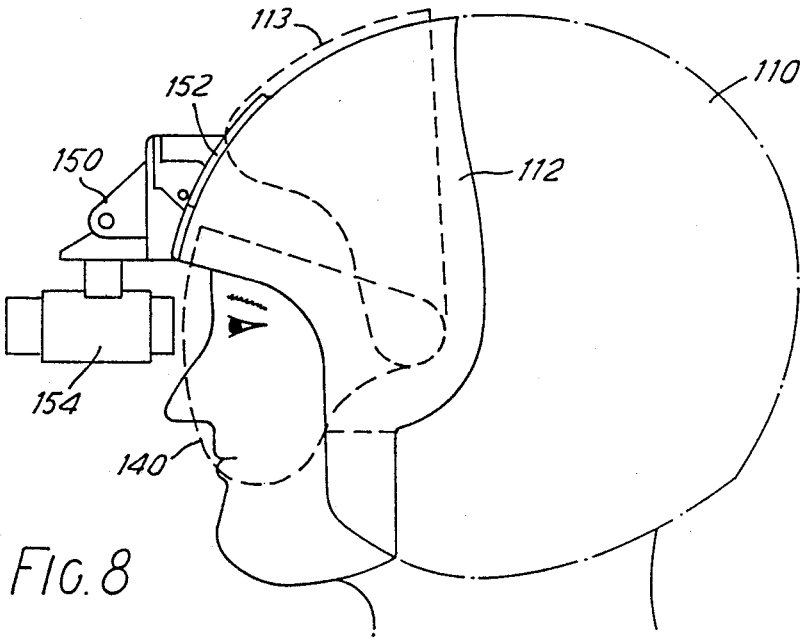
FIG. 8 is a side view of the helmet of FIG. 7.
Figure 9:
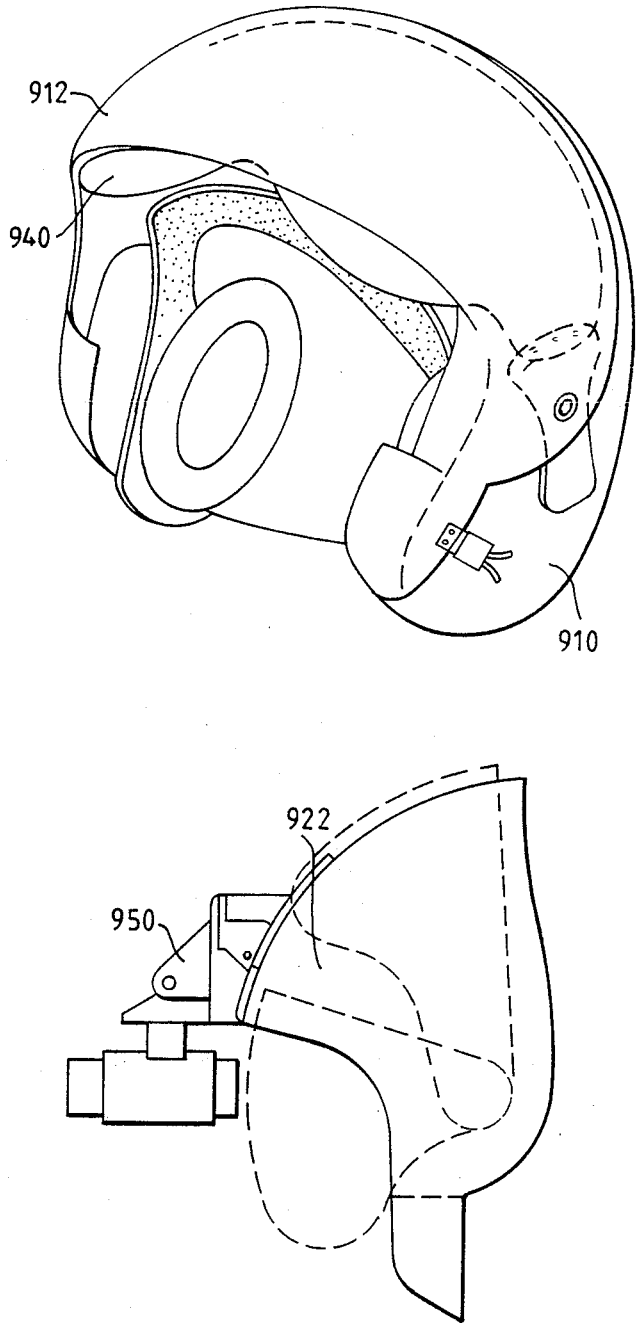
FIG. 9 shows a helmet with two interchangeable front parts.

The helmet shown in FIGS. 7 and 8 has a rear part 110 and a detachable front part 112. The front part 112 is fitted with a conventional visor 113 and also has a second visor 140 accommodated within the front part 112 as in the embodiment of FIGS. 1 to 5. This visor 140 may for example be a protective screen against air blast and bird strike debris, or a visor giving protection against glare or laser light.

Also mounted on the front part 112 of the helmet is a night vision goggles attachment 150. The attachment 150 is fitted to the front part 112 by means of a bracket 152, so that the goggles 154 can be moved to a position in front of the wearer's eyes. The night vision goggles may be of conventional construction. The front part 112 and rear part 110 are detachably held together by suitable catches, as in the embodiment of FIGS. 1 to 6.

I claim:

1. A helmet having a single rear part and two or more interchangeable front parts, the rear part comprising a shell shaped to extend at least partially over the top of the wearer's head and to each side of the head, each of the front parts accommodating a different piece of optical equipment, each front part being shaped to fit against the rear part to complete the shell of the helmet, and means for detachably connecting each front part to the rear part.

2. A helmet as claimed in claim 1, in which each front part of the helmet is shaped to accommodate the equipment so that the equipment is at least partially enclosed by the helmet.

3. A helmet as claimed in claim 1, in which the rear part and each front part of the helmet are provided with complementary facing surfaces which engage one another when the parts are conncted together.

4. A helmet as claimed in claim 1, in which the means for connecting the front and rear parts together includes means pivotally connecting the two parts so that the front part can be pivoted upwards from the closed position to enable the helmet to be donned and doffed.

5. A helmet as claimed in claim 1, in which the optical equipment on one of the front parts of the helmet includes a visor pivoted on the front part of the helmet movable between an operative position and a retracted position in which it is accommodated in a space defined between the front part and the rear part of the helmet.

6. A helmet as claimed in claim 1, in which the helmet is an aircrew helmet and the rear part of the helmet contains communication equipment for voice communication with the wearer.

* * * * *